US007399267B2

(12) United States Patent
Moen

(10) Patent No.: US 7,399,267 B2
(45) Date of Patent: Jul. 15, 2008

(54) METHOD AND APPARATUS FOR VACUUM ASSISTED BONDING OF CORRUGATED CARDBOARD AND FOR MANUFACTURING CORRUGATED CARDBOARD

(76) Inventor: Lenard E. Moen, 7914 Michigan Ave., Whittier, CA (US) 90602

( * ) Notice: Subject to any disclaimer, the term of this patent is extended or adjusted under 35 U.S.C. 154(b) by 41 days.

(21) Appl. No.: 11/110,048

(22) Filed: Apr. 19, 2005

(65) Prior Publication Data

US 2006/0025293 A1 Feb. 2, 2006

Related U.S. Application Data

(60) Provisional application No. 60/565,548, filed on Apr. 27, 2004.

(51) Int. Cl.
*B31F 1/20* (2006.01)

(52) U.S. Cl. ..... 493/463; 493/123; 493/315; 493/101

(58) Field of Classification Search ..... 493/101, 493/123, 313, 315, 463
See application file for complete search history.

(56) References Cited

U.S. PATENT DOCUMENTS 4,046,001 A * 9/1977 Maeda et al. ..... 73/774
4,052,931 A * 10/1977 Morse et al. ..... 493/101
4,095,554 A * 6/1978 Moen ..... 118/711
4,157,149 A * 6/1979 Moen ..... 222/486
4,245,975 A * 1/1981 Hattori ..... 425/363
4,251,313 A * 2/1981 Abe ..... 156/473
4,381,212 A * 4/1983 Roberts ..... 156/473
4,723,935 A * 2/1988 Furukawa ..... 493/100
4,735,031 A * 4/1988 Langen ..... 53/122
4,853,072 A * 8/1989 Thompson ..... 156/470
4,874,354 A * 10/1989 Johnson et al. ..... 493/101
5,926,973 A * 7/1999 Marschke ..... 34/634
5,993,587 A * 11/1999 Seki et al. ..... 156/210
6,511,623 B1 * 1/2003 Ueda et al. ..... 264/161
6,800,052 B1 * 10/2004 Abe ..... 493/463
6,871,480 B1 * 3/2005 Goodrich ..... 53/461
6,910,996 B1 * 6/2005 Patz ..... 493/463
6,913,570 B2 * 7/2005 Kehrle ..... 493/451

* cited by examiner

*Primary Examiner*—Sameh H. Tawfik
(74) *Attorney, Agent, or Firm*—Christie, Parker & Hale, LLP.

(57) ABSTRACT

An apparatus and method for the vacuum assisted bonding of sections of corrugated cardboard and for manufacturing corrugated cardboard. A pressure plate has a bore for applying a vacuum therethrough. A first section of corrugated cardboard has an orifice which is aligned with the bore in the pressure plate. Adhesive is applied between the first section of corrugated cardboard and a second section of corrugated cardboard and the second section is placed adjacent to the first section away from the pressure plate. A vacuum is applied through the bore in the pressure plate and orifice in the first sections to cause the first and second sections to be drawn and adhered together. In the manufacture of corrugated cardboard, vacuum and optionally hot air are applied to opposite edges of the sandwiched core of fluted linerboard with adhesive and overlaying flat linerboard to draw them together to form the corrugated cardboard.

8 Claims, 8 Drawing Sheets

102
120
108
112
106
110
116
128
102
114
104
112
116
110
106
114
108
100
118
128

128
114

110
116
106
110
112

114
110
110

114
130
18
18

130
130
110
110
128
128
114

166
164
162
19
160
142
164
154
162
160
160
154
166
140

19

176
180
178
170
TRAVEL
174
172

METHOD AND APPARATUS FOR VACUUM ASSISTED BONDING OF CORRUGATED CARDBOARD AND FOR MANUFACTURING CORRUGATED CARDBOARD

CROSS-REFERENCE TO RELATED APPLICATION(S)

This application claims the benefit of U.S. Provisional Application No. 60/565,548, filed on Apr. 27, 2004.

BACKGROUND OF THE INVENTION

The present invention relates to the manufacture of paperboard boxes and, more particularly, an improved method of dispersing adhesives between two opposing surfaces of paperboard material for securely bonding them together, for example, for manufacturing corrugated cardboard and adhering together sections of corrugated cardboard.

A wide variety of machinery is employed in assembling and sealing a very great variety of designs of containers or boxes made of paperboard or corrugated cardboard material. The box designs commonly require that different panels of a single blank of material or that a pair of complementary panels of a plurality of blanks be glued together in laminated relationship. A common method of dispersing adhesive between two such opposing surfaces is to apply mechanical pressure external to the bonding surfaces. The means of applying mechanical pressure may be opposing rollers, traveling belts, pressure plates, wedging a material between two pressure members or other similar mechanical arrangements.

The application of pressure effects the dispersal of the adhesive for bonding the pair of panels together but, particularly in the case of corrugated board panels, the structure of the board limits how much pressure can be applied. Corrugated board is well known for its strength under a load applied to the flute ends, as in an edge crush test, but it is not well adapted to resist crushing under loads applied to the face of the board. Thus, the amount of pressure applied to the faces of the corrugated cardboard must be moderated to avoid damage to the cardboard. Also, as a hot melt adhesive is commonly employed in the case of corrugated board, if its heat energy is not rapidly transferred into the adjacent structures, a relatively long dwell time during which the pressure is applied is required for penetration of the fiber of the board by the adhesive so that only relatively low production rates can be achieved.

Additionally, there are also types of box designs in which it is not possible to develop adequate dispersing pressure mechanically because mechanical means can only be applied from one side of the mating components.

Corrugated cardboard consists of a fluted core of material that is sandwiched between a top and a bottom layer of linerboard. In the manufacture of corrugated cardboard, linerboard (a special type of flat cardboard sheet) is softened with steam to make it pliable. The pliable linerboard is then fed between metal rollers that have special meshed, gear-like teeth which press the board into a series of permanent wavy curves (flutes). Next, an adhesive (e.g., cornstarch or water-based resin) is applied to the tips or apices of the flutes at their tops and bottoms. Flat linerboard is applied to the fluted material and steam heated platens activate the adhesive to adhere the flat linerboard to the fluted linerboard and form the corrugated cardboard sheets. Immediately after its formation, the corrugated cardboard is moist, and must be allowed to dry out. This requires that the newly formed corrugated cardboard be held in a drying area before being used.

There accordingly remains a need for improved methods of manufacturing corrugated cardboard and also better methods for joining adjacent sections of corrugated cardboard in the assemble of corrugated cardboard containers.

SUMMARY OF INVENTION

In the process of this invention, at least one of a pair of paperboard panels that are to be bonded together is provided with a pattern of glue beads, for example, a hot melt adhesive. The other panel, which may be called a vent panel, is provided with a hole which will be located substantially centrally of the glue pattern on the first panel when the two panels are brought into a desired registration with one another. The glue beads on the adhesive bearing panel terminate short of the edges of that panel and so they will not interfere with or obstruct the coming into contact with one another of the peripheral areas of the two panels. When the two panels are brought into registration a vacuum is applied by the vent hole to thereby press the pair of panels together by atmospheric pressure. In cases where the pair of panels are made of a corrugated board material, those flutes of the vent panel which communicate with the vent hole may be pinched off at their ends to avoid interference with the action of the vacuum source acting through the vent hole. As the vacuum is generated between the faces of the opposing panels, the beads of glue are compressed and laterally dispersed by the action of ambient or atmospheric pressure acting not only on the opposite or outer faces of the pair of panels but also by virtue of residual ambient or atmospheric pressure present within the flutes of the material.

The invention further comprises an apparatus for effecting the vacuum induced compression of glue beads between a pair of registered panels as well as the adaptation of paperboard or corrugated board blanks designed to utilize the method of invention.

The invention yet further comprises an apparatus and method for manufacturing corrugated cardboard that utilizes a air pressure differential, e.g., a vacuum force, to cause flat layers of linerboard to be drawn into contact with a fluted core to eliminate or reduce an extra drying step in the manufacturing of corrugated cardboard.

DETAILED DESCRIPTION OF THE INVENTION

Figure 1:
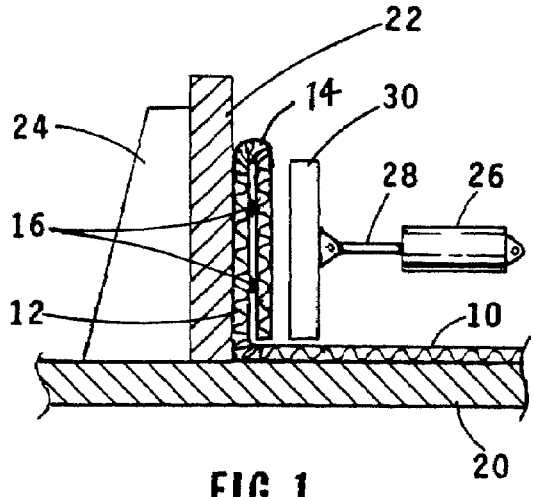
FIG. 1 is a schematic illustration of a prior art apparatus for mechanically applying pressure to a pair of corrugated cardboard panels positioned in registration with one another and having a pair of glue beads of hot melt adhesive disposed therebetween, the parts being illustrated in their positions prior to actuation of the apparatus.
Figure 2:
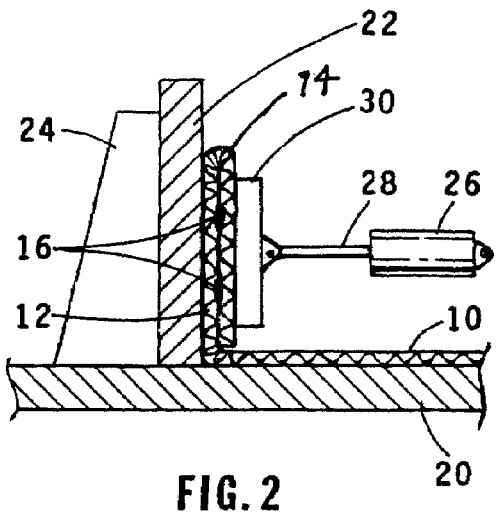
FIG. 2 PRIOR ART
FIG. 2 is a drawing of the apparatus of FIG. 1 with the parts in their positions after actuation of the apparatus to disperse the glue beads.

FIGS. 1 and 2 show portions of a prior art corrugated cardboard blank that has been scored to define a bottom panel 10, an upstanding panel 12 and a further panel 14 that is integral with the panel 12 and reversely bent thereover to capture a pair of parallel spaced apart glue beads 16 therebetween. It will be understood that the initially flat blank has been moved in a direction normal to the plane of the figures so that the panels 12 and 14 are sequentially moved, as by shoes, out of the plane of the bottom panel 10 to the final positions shown in FIGS. 1 and 2. The glue beads 16 typically comprise elongate beads deposited on the inside face of the panel 12 before the panel 14 is folded thereover.

The prior art apparatus of FIGS. 1 and 2 comprises a horizontal frame 20 that is fitted at one side with an upstanding pressure plate 22 that is reinforced on one side by a buttress plate 24. Another part of the framework (not shown) fixedly supports a horizontally oriented pneumatic cylinder 26 fitted with a piston rod 28 that at an inner end carries a plate 30 of a shape and area complementary to that of folded panels 12 and 14. After a folded blank arrives at the position indicated in FIG. 1, wherein panels 12 and 14 are positioned in registration with one another between plates 22 and 30, cylinder 26 is energized for extension of the piston rod 28 to forcefully press the panels 12 and 14 together against the pressure plate to compress and disperse the glue beads 16 to laminate the panels 12 and 14 together, as in FIG. 2.

Figure 3:
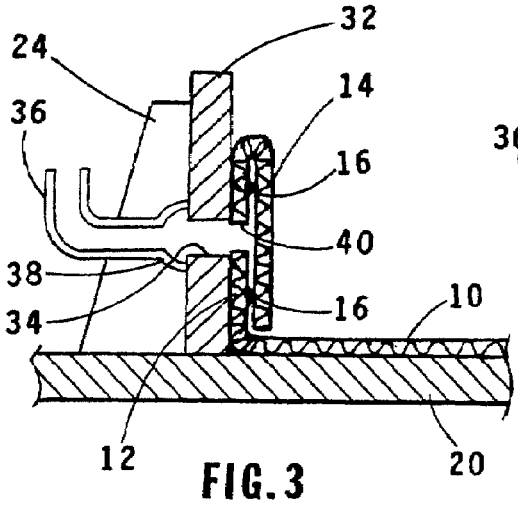
FIG. 3 is an exemplary schematic illustration of an apparatus of this invention illustrating a pair of panels of corrugated cardboard in registration with one another and prior to actuation of the apparatus in order to disperse a pair of glue beads of a hot melt adhesive disposed between the panels.
Figure 4:
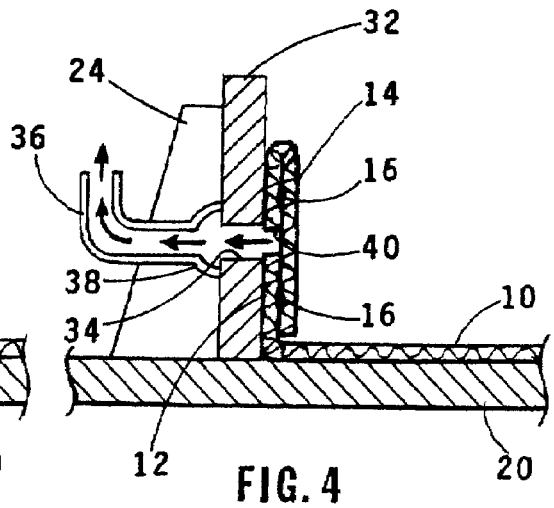
FIG. 4 is an exemplary schematic illustration of the apparatus of FIG. 3 after its actuation has glued the registered panels together.

FIGS. 3 and 4 schematically show an embodiment of the present invention that eliminates the need for a mechanical means of applying pressure to a set or pair of registered panels of cardboard which are to be glued together. This embodiment also illustrates that the gluing may be accomplished in a variety of situations, including where the box design can only be produced in a machine that does not permit a mechanical means of applying pressure to be disposed within the die cavity of the machine.

More particularly, the apparatus of FIGS. of 3 and 4 comprises a horizontal frame 20 fitted at one side with an upstanding plate 32 that may be reinforced on the outside of the die cavity by a buttress plate 24. The plate 32 is formed with a through bore 34 that opens into fluid communication with a conduit 36 through bell mouth 38 secured to the outside of the plate 32 around the orifice or bore 34. The other end of the conduit 36 operatively communicates with a vacuum pump. While a single bore is shown, a plurality of bores connected to vacuum lines may be provided.

For purposes of this invention, the corrugated cardboard blank illustrated in FIGS. 1 and 2 is modified to bring the interface between the panels 12 and 14 into fluid communication with the vacuum source. More particularly, as before, the bottom panel 10 has integral upstanding panel 12 and bent over panel 14 which capture the parallel spaced apart glue beads 16 therebetween. However, the panel 12 is formed with a vent hole 40 which is located, during the design of the container, so as to come into substantially centered registration with the inlet end 38 of the vent pipe 36 and the bore 34 through the plate 32. More holes can be proved if desired. As before, it should be understood that the initially flat blank has been moved in a direction normal to the plane of FIGS. 3 and 4 for purposes of rolling over or shoeing the panels 12 and 14 and depositing the glue beads 16. Thus, the glue beads 16, as viewed in FIGS. 3 and 4, are parallel to the direction of the flutes of the fluted media of the corrugated cardboard of which the container is to be made. However, the opposite terminal ends of the glue beads 16 terminate short of the edges of the registered and overlapping panels 12 and 14 and so will not obstruct the coming into contact with one another of the peripheral areas of the two panels. Thus, when the vacuum pump (not shown) is actuated the accelerated air drawn into and through the interface between the liner boards between the registered panels 12 and 14 is at a reduced pressure such that relatively static ambient atmospheric pressure within the fluted media of the panels and on the outer liner of the panel 14 effects compression and lateral dispersion of the glue beads 16.

Figure 5:
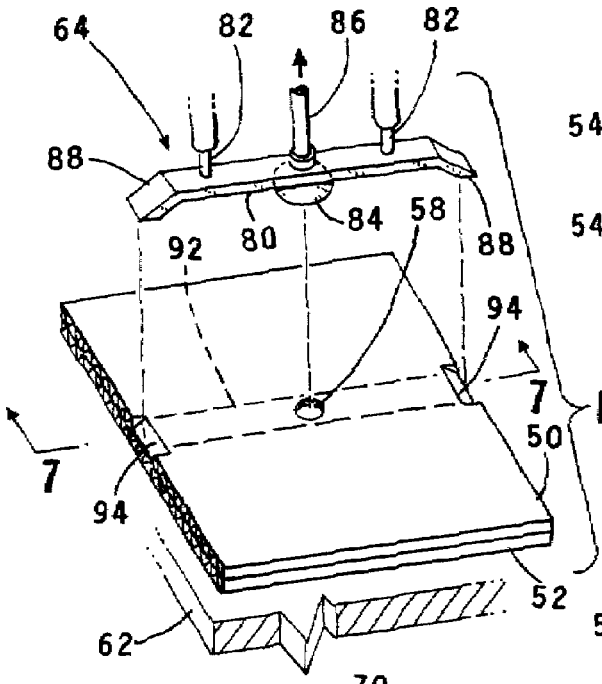
FIG. 5 is an exemplary schematic illustration of another embodiment of the invention showing a laminated pair of corrugated cardboard panels after the action of a pinch bar and vacuum source assembly superposed the thereabove.

Another embodiment of the invention and its mode of operation are shown in FIGS. 5 through 9. In FIG. 5 a pair of corrugated cardboard panels 50 and 52 are glued in abutting registration with one another. As shown in greater detail in FIGS. 8 and 9 each panel comprises a corrugated media 54 sandwiched between a pair of liner boards 56 to which crests or apices of the fluted media are adhesively secured. While not illustrated, it will be understood that the pair of panels 50, 52 will typically comprise integral portions only of a corrugated cardboard blank of greater area that has been cut and scored for purposes of erecting or making a container of a particular design.

In FIG. 5 the panels 50, 52 have been bonded together by means of an apparatus portions of which are shown in the FIG. Typically, the apparatus comprises a pressure plate 62 in operative relationship to a vacuum or sealing cup 84 and pinch bar 80 assembly designated generally by the numeral 64. After other portions of the machine (not shown) have placed the pair of panels 50, 52 into registered abutting relationship upon the pressure plate 62, the assembly 64 is reciprocated into engagement with the top panel 50 in order to adhesively bond the pair of panels together.

Figure 6:
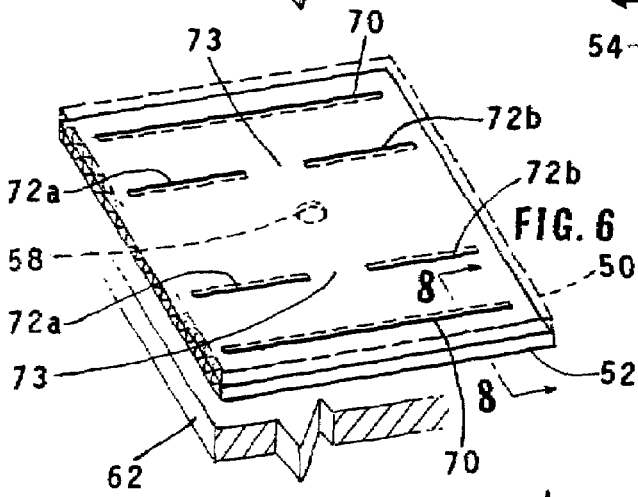
FIG. 6 is a drawing of the pair of panels of FIG. 5 but with the top or vent panel illustrated in phantom outline to illustrate the relationship of the vent hole of the top panel to pairs of glue beads on the lower panel.
Figure 7:
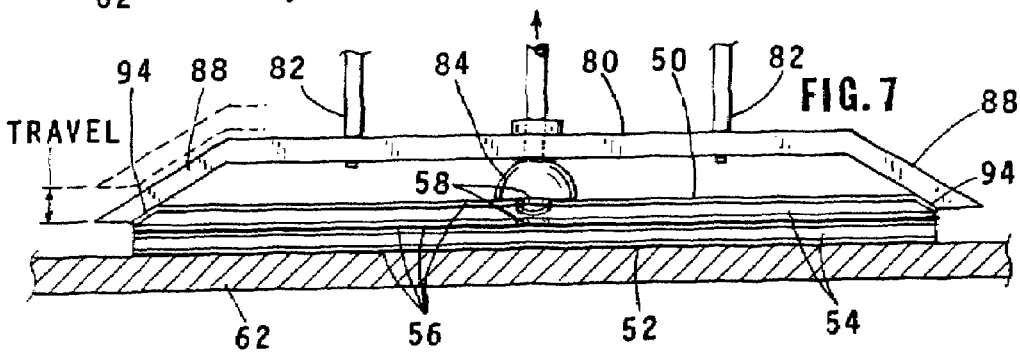
FIG. 7 is a view taken on the line 7-7 of FIG. 5 but with the pinch bar and vacuum source assembly lowered into operative contact with the top panel, a retracted position of the assembly being indicated in phantom outline.

More particularly, the top panel 50 is formed with a hole 58 that has been cut therethrough. The hole 58 is so located on the panel 50 that when brought into contact with the panel 52 the hole will be positioned centrally with respect to a pattern of glue beads that have been deposited on the other panel 52. As shown in FIG. 6, the glue pattern may comprise a pair of continuous glue beads 70 and a pair of segmented glue beads 72*a* and 72*b* between the pair of beads 70. Each of the beads 70, 72*a* and 72*b* have ends positioned away from the edge of the panel so as to permit positive engagement of the confronting liner boards of the pair of panels in the peripheral areas thereof. As adjacent ends of the segmented glue beads 72*a*, 72*b* are spaced apart the gaps 73 thus created permit fluid flow to the hole 58 from throughout what is in effect a plenum area between the contacting liner boards of the pair of panels and between the relatively remote glue beads 70. Other bead patterns may be used, including bead segments or spots that are perpendicular or diagonal to the flutes in the corrugated cardboard.

The assembly 64 comprises a pinch bar 80 mounted on a parallel pair of shafts 82 for powered reciprocation towards and away from a pair of panels that have been positioned on the pressure plate 62. A vacuum or sealing cup 84 is mounted, e.g., centrally on the underside of the pinch bar 80 in operative fluid communication with a vacuum source through a duct or hose 86 extending from the top side of the bar 80. As will be seen from FIG. 5, the bar 80 is a length to span the pair of panels 50, 52 and is oriented parallel to the direction of the flutes of the panels and of the glue beads 70, 72*a* and 72*b*. The area of the flutes intercepted by the vent hole 58 in the top panel is indicated in the dotted outline area 92 of FIG. 5.

When the assembly 64 is brought down into contact with the upper panel 50, vacuum or sealing cup 84 communicates with the flutes of panel so underlying the width of the bar 80. Therefore, to insure that the vacuum source will draw fluid primarily from the interface between the contacting liner boards 56 of the panels 50, 52, instead of the area 92 flutes, the bar 80 incorporates turned down opposite ends 88. When the assembly 64 is lowered the ends 88 of the bar 80 engage the upper exposed ends of the outer liner board at the opposite ends of the area 92 and deform the liner board in the areas 94 to close off opposite ends of those flutes of area 92 that intersect the vent hole 58.

Figure 8:
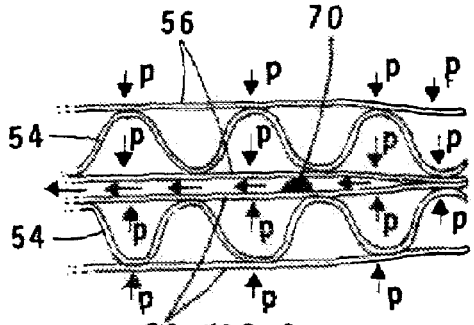
FIG. 8 is a sectional view on the line 8-8 of FIG. 6, on an enlarged scale, schematically illustrating an initial phase of compression of a glue bead under the influence of the vacuum as applied in FIG. 7.
Figure 9:
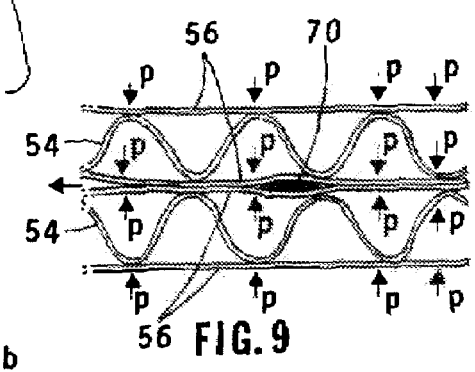
FIG. 9 is a view similar to FIG. 8 schematically illustrating the further compression of a glue bead under the influence of atmospheric pressure applied to the pair of registered panels.

In operation, after the glue beads 70, 72*a*, 72*b* have been applied to the panel 52 the top panel 50 is brought into registration with panel 52. The assembly 64 is then lowered onto the area 92 of the panel 50 to form the closure tabs 94 out of the top or outer liner board of the panel 50 while the vacuum pump is turned on to draw air into and between the interface between the opposed inner liner boards 50 of the pair of panels 50, 52. As is indicated in FIG. 8, the vacuum force is generated progressively from the vent hole 58 and increases progressively towards the periphery of the registered panels 50, 52. As the vacuum is applied between the opposing inner liners of the two corrugated panels, the atmospheric pressure within the flute structure, as indicated by the letters P in the drawing, becomes a force that drives the inner liners together. As that force acts on the liners the adhesive between them, in the illustrated case a glue bead 70, is displaced laterally and into the liner board matrix until solidification by heat loss is achieved. Rapid heat loss and bonding is achieved by effective dispersion as indicated in FIG. 9 by the widened glue bead 70.

The widening of the pair of glue beads 70 and pairs of glue beads 72*a* and 72*b* is also schematically indicated by the dotted outline adjacent each of the glue beads shown in FIG. 6.

Figures 10, 11, 12, 13, 14, 15, 16, 17, 18:
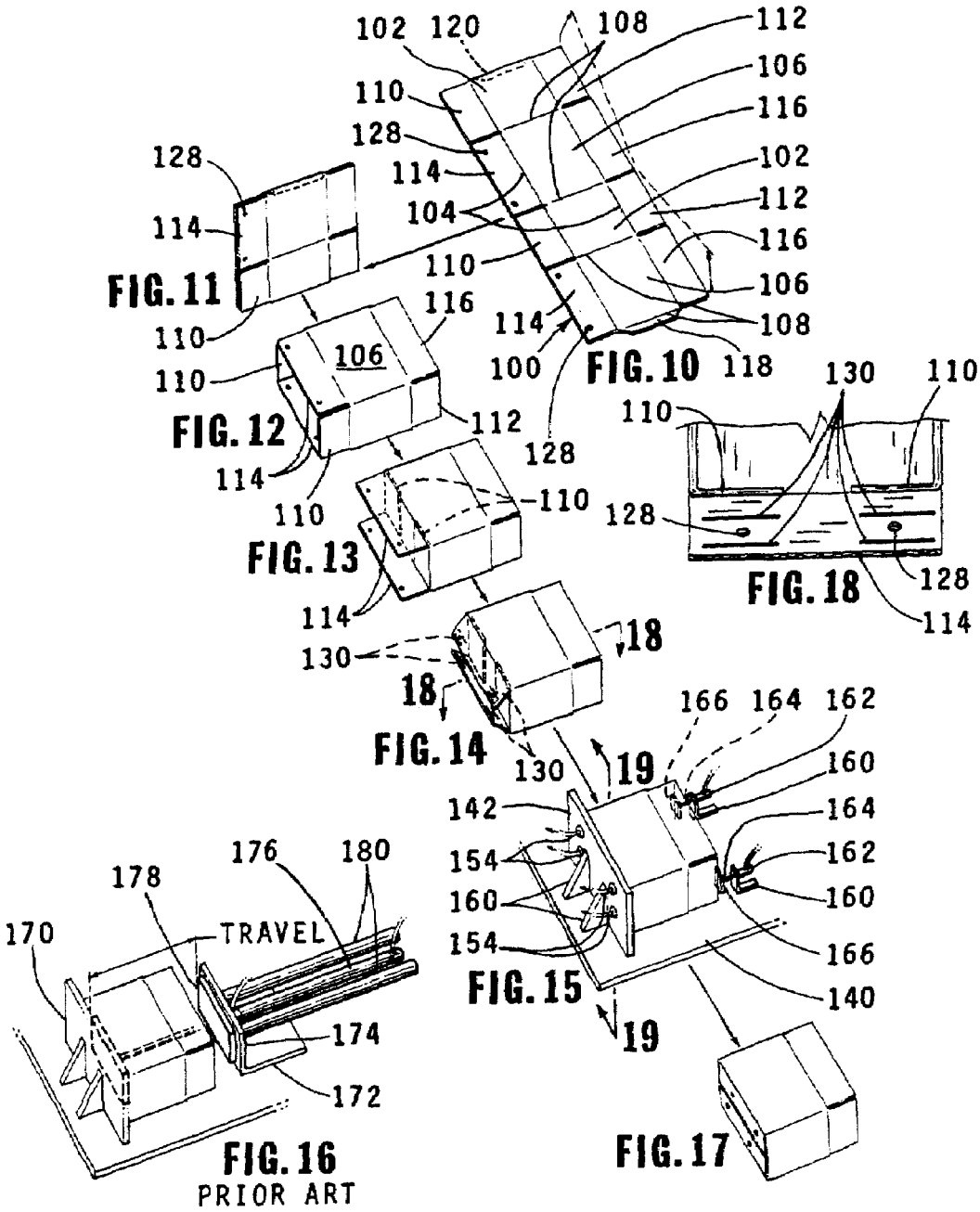
FIG. 16 PRIOR ART
FIG. 10 is a perspective view of an exemplary cardboard blank that has been die cut and scored in preparation for erection into an RSC container.
FIGS. 11 to 15 and FIG. 17 schematically illustrate the formation of the blank of FIG. 10 into a completed RSC container by use of the present invention.
FIG. 16 is a schematic illustration of a prior art mechanism such as would be employed in making the container of FIG. 17 at that phase the operation illustrated in FIG. 15.
FIG. 18 is a view taken on the line 18-18 of FIG. 14 particularly illustrating the relationship of the glue beads on a major flap of the container blank relative to the vacuum source access holes associated therewith.

An application of the invention in the forming of RSC containers is shown in FIGS. 10 through 15, and 17 through 20. In FIG. 10, pre-formed RSC blank is cut and scored to define a blank 100 of a well-known basic form. The blank comprises a pair of end wall panels 102 and a pair of sidewall panels 106 defined by a pair of longitudinal press scores 104 and four transverse press scores 108. Each of the end wall panels 102 has an integrally formed bottom minor flap 110 and a top minor flap 112. Similarly, each of the sidewall panels has a integrally formed major bottom closure flap 114, and a top closure flap 116. At one end of the blank, the side wall panel 106 has an integrally formed laterally projecting tab 118 such that when the blank 100 is folded at its lateral mid-line, as indicated by the fold arrows, the tab 118 comes into registration with a pre-glued area 120 whereby the blank is folded in half and glued into the flat configuration shown in FIG. 11.

The blank 100 of FIG. 10 is conventional except that in accordance with this invention, each of the bottom major flaps 114 is formed with a spaced pair of vent holes 128 therethrough. Each hole is located such that it is positioned substantially centrally with respect to a pattern of glue beads 130 which is to be deposited on the inner face thereof during the formation and erection of the blank 100 into a completed RSC container. More particularly, it will be understood that the blank 100 is shipped from the manufacturer to an end user in the flat folded condition illustrated in FIG. 11. Conventional machinery is then employed by the end user to effect the operations illustrated in FIGS. 11 through 18 on a conveyer (not shown) towards a station illustrated in FIG. 15 wherein the major and minor flaps of the container are glued together in accordance with the method and machine of this invention.

In the transition between the stations in FIGS. 11 and 12, the blank 100 is unfolded into a tubular form in which the major and minor flaps are maintained in a substantially coplanar relationship with their corresponding side and end walls. As the opened blank proceeds toward the FIG. 13 position, the bottom minor flaps 110 of the pair of end walls are rotated inwardly 90 degrees as the blank proceeds from the FIG. 13 station to that of FIG. 14. A slight pinch force applied to the upper sidewall 106 along its fold line 104 maintains the minor flaps 110 in the 90 degree folded position. In this phase, two pairs of glue beads 130 are deposited on the bottom major flaps 114 of the pair of sidewalls 106. As is shown in FIG. 18, each pair of glue beads 130 is arranged on opposite sides of a corresponding vent hole 128 at that end of the major bottom flap. Thereafter, the major bottom flaps 114 are rotated 90 degrees into contact with the previously folded minor flaps 110. The container is then carried into the glue station shown in FIG. 15.

Figure 19:
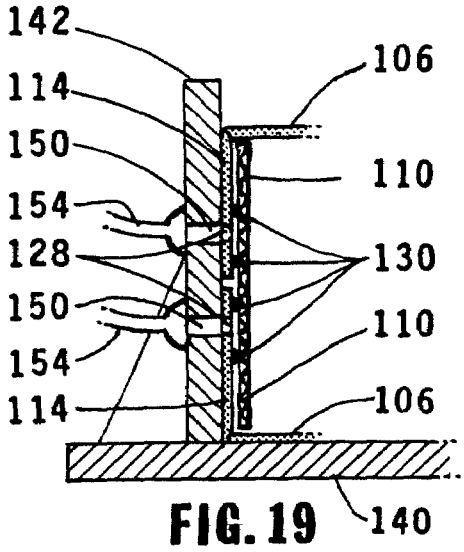
FIG. 19 is a view on the line 19-19 of FIG. 15, on an enlarged scale.
Figure 20:
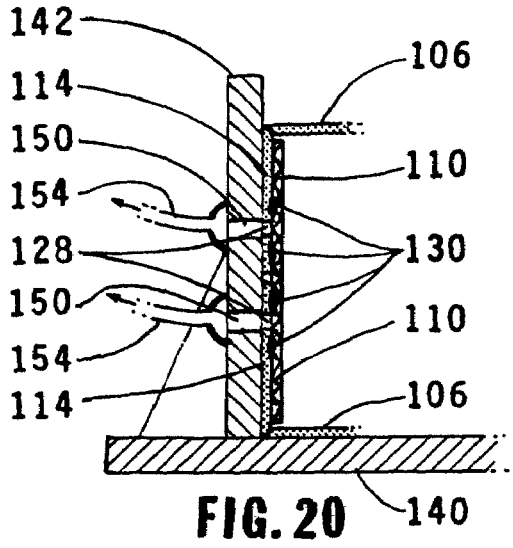
FIG. 20 is a view like FIG. 19 after actuation of the apparatus in order to effect compression and dispersal of the glue beads for laminating together the minor and major flaps of the completed container of FIG. 17.

The glue station has a table 140 on which a pressure plate 142 is positioned in an orientation to receive the formed container after the major bottom flaps 114 have been rotated 90 degrees. On its outside surface, the pressure plate has a spaced pair of buttress plates 144. As is shown in FIGS. 19 and 20, the pressure plate 142 is formed with two pairs of vertically spaced apart vent holes 150 that open into communication with corresponding ones of the vent holes 128 of one of the major bottom flaps 114. On the outside of the pressure plate 142 each vent hole 150 opens into fluid communication with a duct 154 that is operatively connected to a vacuum source.

Positioned in opposing relationship to the pressure plate 142, the conveyor table 140 supports a spaced apart pair of rigidly positioned brackets 160. Each bracket 160 supports a short stroke pneumatic cylinder 162 from which a piston rod 164 extends and mounts a platelet 166. As is indicated in FIG. 15, each of the cylinders 162 is oriented in alignment with a minor top flap 112 such that when a partially completed container is positioned in the glue station, actuation of the cylinders 162 causes extension of the piston rods and platelets 166 against the top minor flaps to press the bottom major flaps 114 against the inside face of the pressure plate 142.

The orientation of the fluted media of an RSC container is as depicted in FIGS. 18, 19 and 20, i.e., necessarily in the vertical direction of the upright box. Accordingly, when the bottom major flaps 114 have been rotated 90 degrees relative to their corresponding sidewalls 106 along the corresponding press score hinge lines 104, the flutes through the major flaps are effectively choked off by the hinge score and will not impede the effectiveness of the vacuum acting through the vent holes 128 in spite of the fact that the flutes in the sidewall 106 are open to atmosphere at their upper ends. Referring to FIG. 19, a pair of parallel glue beads 130 have been deposited on opposite sides of corresponding vent hole 128. Upon energization of the vacuum source, as in FIG. 20, the glue beads are dispersed and the minor flaps 110 are glued to the major flaps 114 in essentially the same manner as previously described with reference to FIGS. 8 and 9.

When the vacuum source is de-energized and the short stroke cylinders 162 are actuated to retract the platelets 166 from the minor flaps 112, the completed RSC container can then be conveyed out of the machine as in FIG. 17.

FIG. 16 is illustrative of heretofore available glue stations of RSC box formers. The fully formed, but unglued, container is positioned between a buttressed pressure plate 170 and an angular frame member 172. The bottom major closure flaps of the container are flush against the inside face of the pressure plate 170. The angular member 172 has an upstanding flange 174 that rigidly supports a long stroke, e.g., 24 inch, pneumatic cylinder 176 on its backside. The cylinder is positioned between a parallel pair of support tubes 180 that internally slidably support telescopic rods (not shown) extending through the flange to mount a pusher compression plate 178 on the inside of the upstanding flange. The compression plate is complementary in dimension to the internal dimension of the container and oriented to reciprocate into and out of the container upon actuation of the actuating cylinder. The extended position of the pusher plate is indicated in phantom outline. It should be noted that this arrangement requires a very long stroke actuating cylinder substantially in excess of the overall vertical dimension of the container being formed since the stroke must travel through not only the vertical dimension of the open top container but, also, the clearance space required to permit passage of containers in process into and out of the glue station without interference from this mechanical apparatus as they travel through the station on a conveyor.

Figure 21:
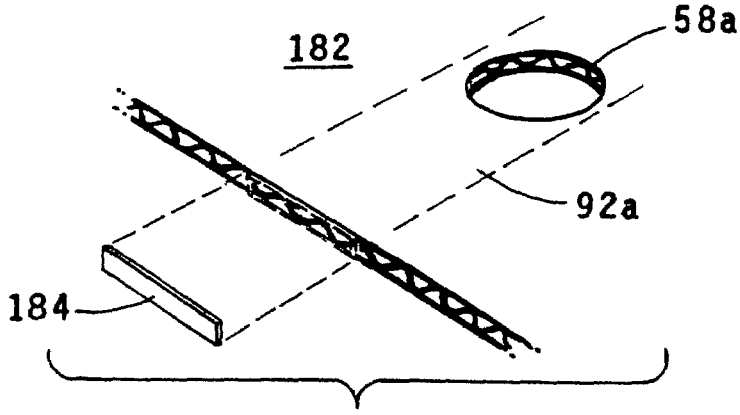
FIG. 21 schematically illustrates another embodiment of the invention for gluing adjacent sections of corrugated cardboard together.

FIG. 21 is illustrative of an alternative means for closing off the ends of the fluted media of an area containing a vent hole through which the vacuum source is to be connected to one side or the other of the depicted area of corrugated board 182. More specifically, the board fragment comprises a fluted media between a pair of liner boards and has a vent hole 58A in an area 92A. A rectangular valve plate 184 and breadth of an essentially impervious material and of a length sufficient to cover and close off the flute ends at one end of the board within the area and 92A is mounted for movement into and out of position against the end of the board.

Figure 22:
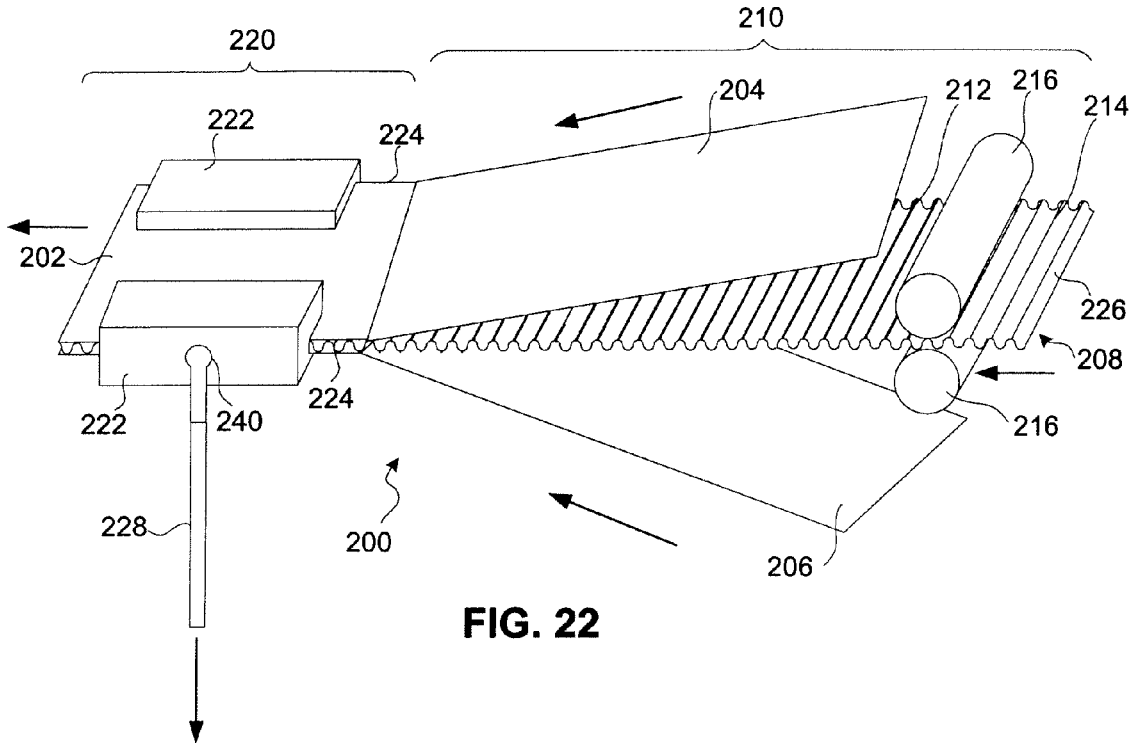
FIG. 22 is an exemplary schematic illustration of a device for forming corrugated cardboard using an air pressure differential to cause flat linerboard to be adhered to a fluted core.

FIG. 22 is an exemplary schematic illustration of an apparatus 200 for forming corrugated cardboard 202 using an air pressure differential to cause upper and lower layers of flat linerboard 204, 206, respectively, to be adhered to a fluted core 208. The fluted core 208 can be formed of known materials such as paper linerboard, but other materials, such as a plastic material could also be used. The portion 210 of the apparatus 200 can be arranged as with conventional devices for manufacturing corrugated cardboard and feeds the upper and lower layers of flat linerboard 204, 206, respectively, in a continuous flow, with a fluted linerboard core 208 provided therebetween. For example, the linerboard 204, 206 and fluted core 208 can be fed from rolls of material (not shown). Adhesive 212 is applied to convex apices 214 of the fluted linerboard, e.g., with adhesive applicators 216. In portion 220, vacuum aspiration manifolds 222 are positioned at longitudinal edges 224 of sandwiched fluted linerboard perpendicular to the longitudinal flutes 226 to draw the upper and lower flat linerboard 204, 206, respectively, into bonding contact with the adhesive 212 on the apices 214 of the fluted linerboard 208 to thereby cause the upper and lower flat linerboard 204, 206 to sandwich therebetween the fluted linerboard 208. A vacuum aspiration line 228 connected to a vacuum fitting 240 on the manifold 222 is used to apply the vacuum that draws together the upper and lower linerboard 204, 206 into bonding contact with the adhesive on the apices of the fluted core 208. The vacuum also acts to draw away moisture from the adhesive 212 and linerboard as it adheres together the upper and lower flat linerboard 204, 206 to the fluted core 208. Since this occurs while the corrugated cardboard is being manufactured, this can eliminate the need for storage of the newly manufactured cardboard in a holding area to allow the cardboard to thoroughly dry out. The vacuum aspiration manifolds 222 of FIG. 22 are illustrated as being relatively short, but will be sized to be long enough, given the manufacturing line speed, glue characteristics and other factors, to permit adequate adhesion of the flat linerboard to the fluted core and to remove any excess moisture. Also, it is possible to use a plurality of vacuum aspiration manifolds 222 arranged along the lateral edges of the corrugated cardboard as it is manufactured, so if desired, different degrees of vacuum can be applied. It is also possible to provide a vacuum manifold along just one lateral edge 224 of the corrugated cardboard, with an opposite lateral edge being sealed off during application of a vacuum e.g. by a U-shaped sealing structure (not shown).

Figure 23:
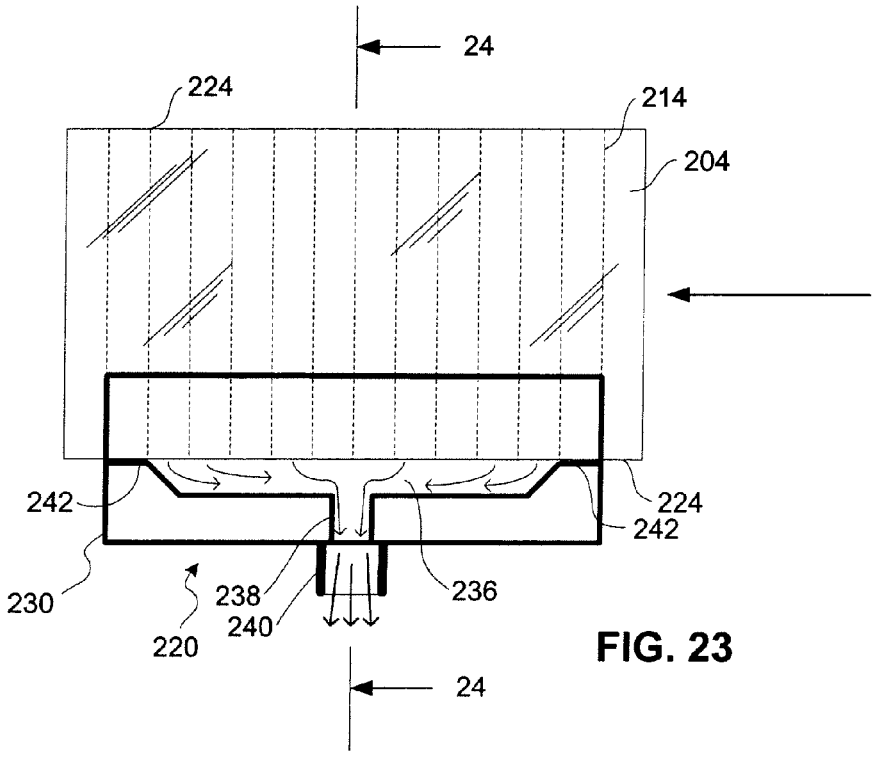
FIG. 23 is a schematic top view of the device of FIG. 22 showing a detail of the interface between an edge of the corrugated cardboard being formed and a vacuum source.
Figure 24:
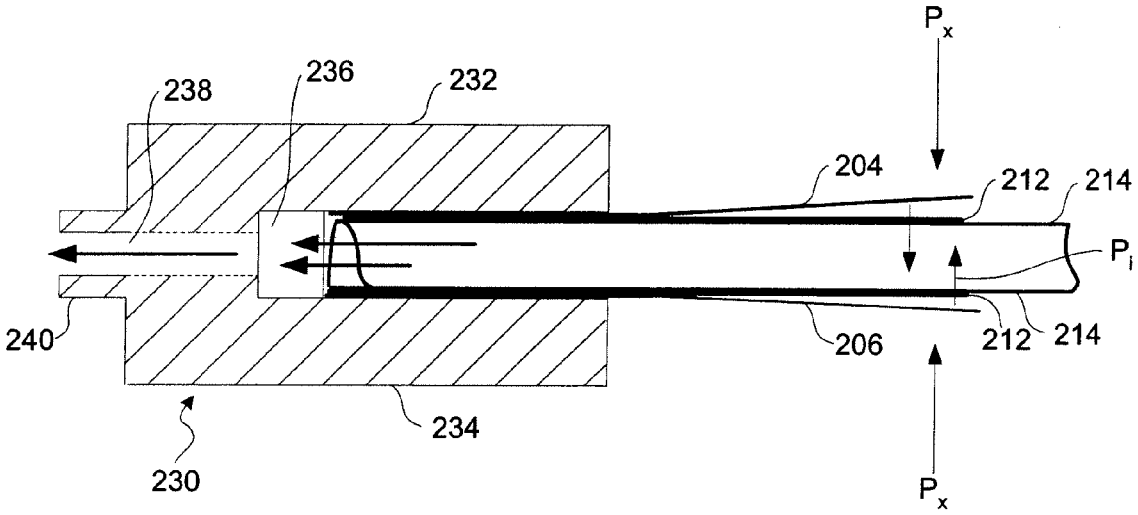
FIG. 24 is a cross-sectional view along view lines 24-24 of FIG. 23.

FIG. 23 is a schematic top view showing a detail of the interface between an edge 224 of the corrugated cardboard being formed and one of the vacuum aspiration manifolds 222. FIG. 24 is a cross-sectional view of the vacuum aspiration manifold 222 along view lines 24-24 of FIG. 23. Each vacuum aspiration manifold 222 comprises a housing 230 with an upper extension 232 and a lower extension 234 and a vacuum cavity 236 that is in fluid communication with a vacuum channel 238 and vacuum fitting 240. The vacuum line 228 is connected to the vacuum fitting 240 and is connected to a vacuum generation device (not shown). The vacuum cavity 236 has end walls 242 which make contact with or are close to making contact with lateral edges 224 of the newly formed corrugated cardboard 202 to reduce vacuum loss. As best shown in FIG. 24, as vacuum is applied, it lowers the air pressure between fluted core 208 and the upper and lower flat linerboards 204 and 206, respectively, from $P_x$, which is the ambient air pressure outside of the device, to a lower air pressure $P_i$. The pressure differential between $P_x$ and $P_i$ provides a motive force that draws the upper and lower flat linerboards 204 and 206 in bonding contact with the adhesive 212 on the apices 214 of the fluted core 208. The vacuum will also draw out any moisture that may remain as a result of the process of forming the fluted core and/or release of moisture from the adhesive 212 as it cures. The vacuum aspiration manifold 222 illustrated in FIGS. 22, 23 and 24 is just one illustrative exemplary embodiment of a device to utilize the air pressure differential between the interior of the corrugated cardboard and the exterior thereof to form corrugated cardboard, and the invention is not limited to this particular exemplary embodiment.

Figure 25:
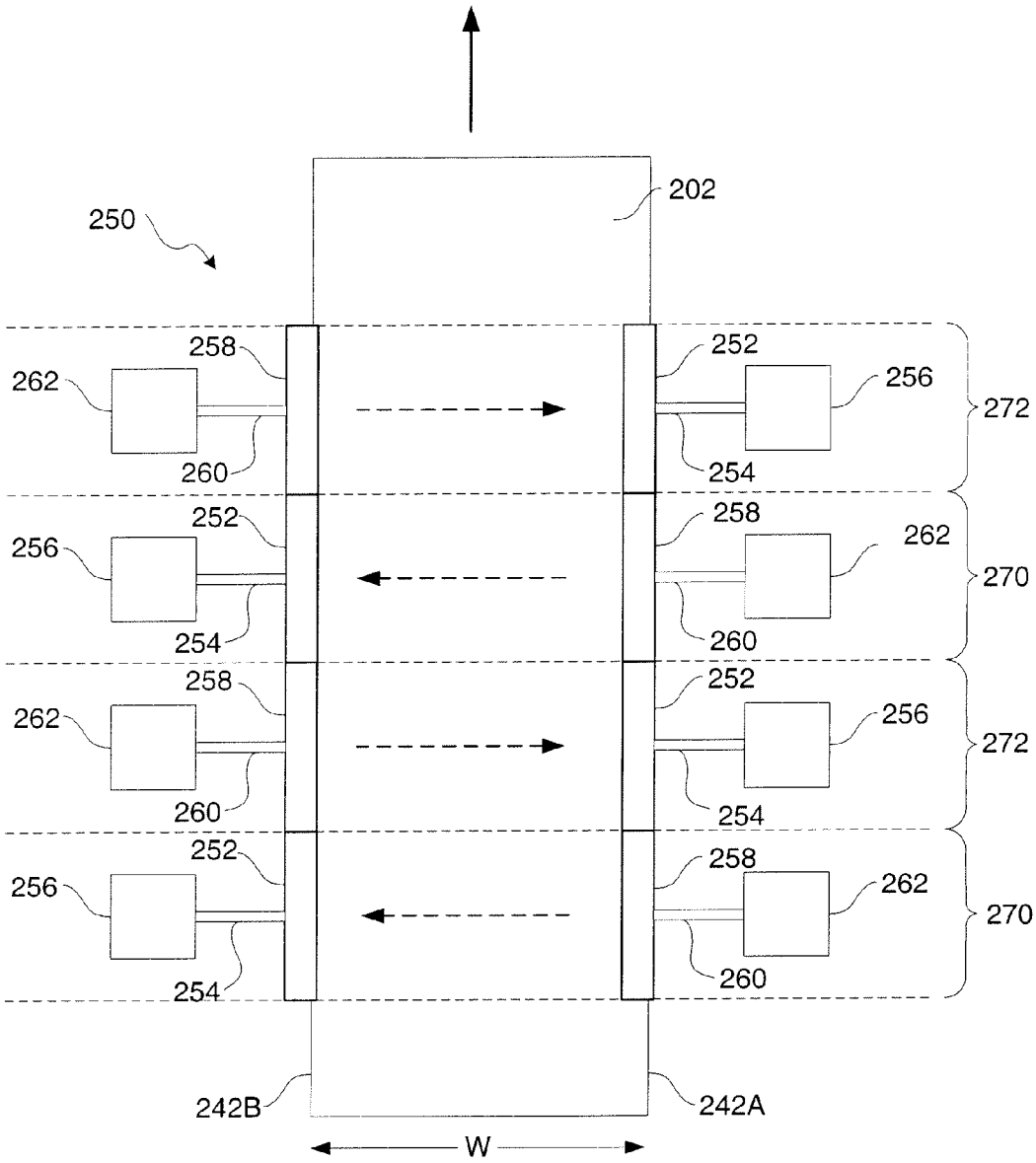
FIG. 25 is a top plan view of another exemplary embodiment of the invention that uses vacuum and hot dry air flow in the manufacturing of corrugated cardboard.

FIG. 25 is a top plan view of another exemplary embodiment 250 of the invention that provides hot dry air flow in addition to a vacuum to manufacture corrugated cardboard 202. In certain situations, it is beneficial to not just rely on vacuum aspiration to draw excess moisture out of the corrugated cardboard as it is being manufactured. In this embodiment, vacuum aspiration manifolds 252 and hot air manifolds 258 are located alternately along side edges 242A, 242B of the corrugated cardboard 202 as it is being manufactured. A vacuum generator 256 draws air through pipes 254 from the vacuum aspiration manifolds 252 to create a vacuum force and a hot air generator 262 pumps hot air through hot air pipe 260 to the hot air manifold 258 at less than ambient air pressure. An air pressure differential will thus be established across the sides 224A and 224B and, in areas 270, will result in hot air flow leftwardly across sides 224A to 224B, and in areas 272, will result in hot air flow rightwardly across sides 224B to 224A, as represented by the dashed horizontal arrows. Since the hot air will cool as it travels through the flutes across the width of the corrugated cardboard, the alternate placement of the vacuum aspiration manifolds 252 and the hot air manifolds 258 will thus help insure that, particularly for wide widths "W" of corrugated cardboard being assembled, that the corrugated cardboard is evenly dried near both edges 224A, 224B and in the middle of the corrugated cardboard. For narrow widths "W" of corrugated cardboard it is also possible to place the vacuum aspiration manifolds 252 and the hot air manifolds 258 on the same side 224A or 224B. As the corrugated cardboard 202 travels down the assembly line (shown in vertical arrow) the degree of vacuum pressure and hot air pressure will ideally be varied as required to result in secure bonding of the upper and lower layers of linerboard to the fluted core without causing crushing of the fluted core or affecting the flat surface of the upper and lower layers of linerboard. This is particularly useful depending on the weight of the linerboard used in the manufacture of the corrugated cardboard, the width of the corrugated cardboard being manufactured and the line speed. This can be done at each region 270, 272 as desired.

Figure 26:
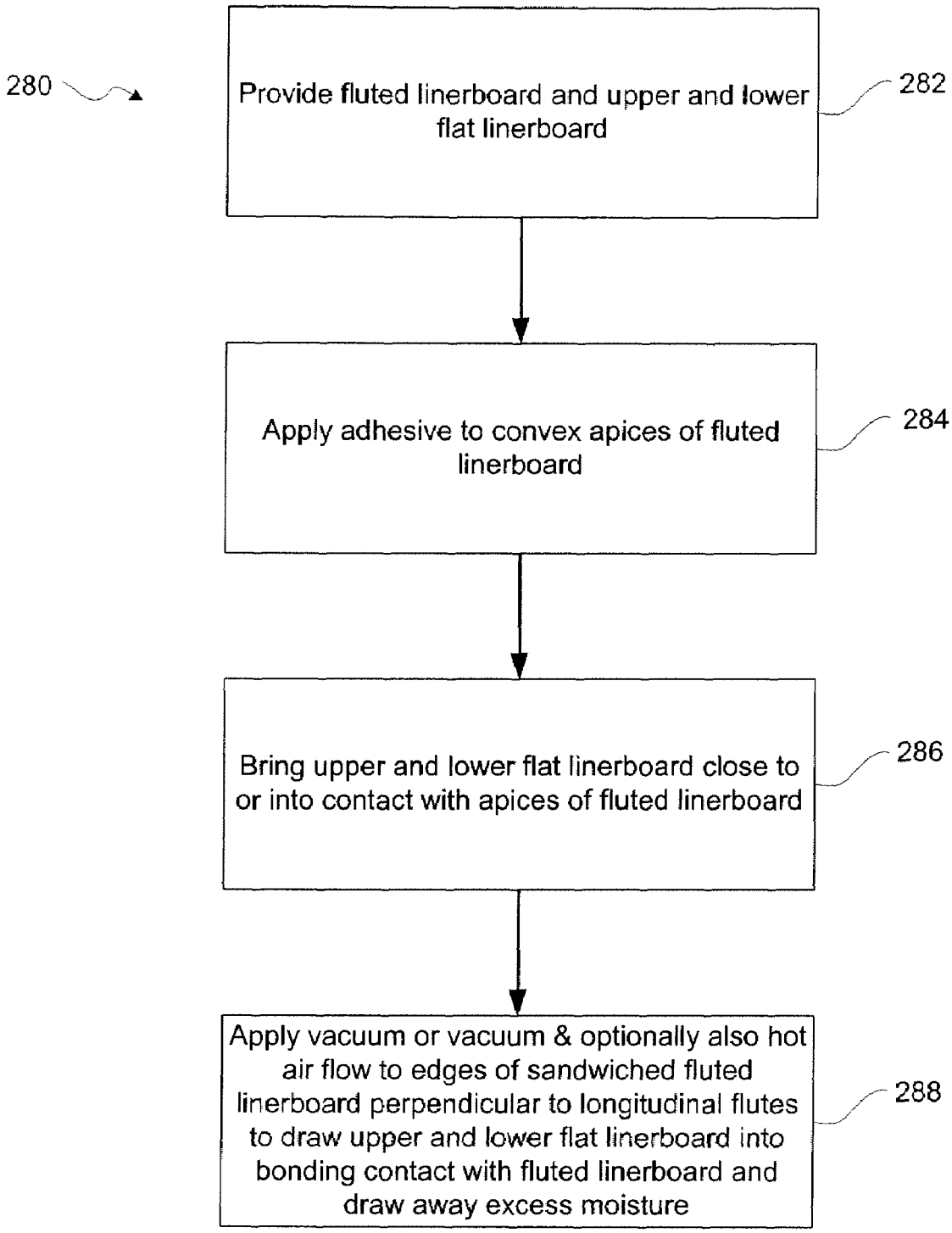
FIG. 26 is a flowchart illustrating an exemplary method for forming corrugated cardboard using an air pressure differential to cause flat linerboard to be adhered to a fluted core.

FIG. 26 is a flowchart illustrating an exemplary method 280 for forming corrugated cardboard using an air pressure differential to cause flat linerboard to be adhered to a fluted core. In a first step 282, fluted linerboard and upper and lower flat linerboards are provided. In a second step 284, adhesive is applied to the convex apices of a fluted linerboard. In a third step 286, the upper and lower flat linerboards are brought into contact or close to the apices of fluted linerboard. In a step 288, a vacuum is applied to the edges of a sandwiched fluted linerboard that is perpendicular to the longitudinal flutes to draw the upper and lower flat linerboard into bonding contact with the fluted linerboard and draw away any excess moisture. In a fourth step 288, hot air may optionally be passed through the fluted linerboard to aid in removing excess moisture from the corrugated cardboard being manufactured. After being formed, the corrugated cardboard can be cut into appropriate sized pieces and further used with any extra drying step.

Although the device and method are described with relation to a single ply of corrugated cardboard, multiply corrugated cardboard can be manufactured using the same basic device and methodology, except that there will be a plurality of corrugated inner cores and a one or more inner flat linerboard sheets adhered between adjacent inner fluted cores.

Those skilled in the art will understand that various modifications may be made to the described embodiment. Moreover, to those skilled in the various arts, the invention itself herein will suggest solutions to other tasks and adaptations for other applications. It is therefore desired that the present embodiments be considered in all respects as illustrative and not restrictive, reference being made to the appended claims rather than the foregoing description to indicate the scope of the invention.

What is claimed is:

1. A method for manufacturing corrugated cardboard, comprising:

providing a core of fluted linerboard with elongate flutes having a series of convex apices;

applying adhesive to the convex apices of the fluted linerboard;

providing upper and lower sheets of linerboard to sandwich the core of fluted linerboard therebetween;

applying a vacuum along a longitudinal edge of the fluted linerboard sandwiched by the upper and lower sheets of linerboard to reduce the pressure between the upper and lower sheets of linerboard to cause the upper and lower sheets of linerboard to be drawn into bonding contact with the core of fluted linerboard; and removing excess moisture from the fluted linerboard and upper and lower sheets of linerboard to dry out the corrugated cardboard as it is being manufactured by passing pre-heated hot air through the fluted linerboard.

2. The method of claim 1, wherein the core of fluted linerboard and upper and lower sheets of linerboard are fed on an assembly line in a direction of travel perpendicular to a longitudinal direction of the flutes.

3. The method of claim 1, wherein a vacuum is applied along both longitudinal edges of the fluted linerboard sandwiched by the upper and lower sheets of linerboard.

4. The method of claim 1, wherein the combination of the application of vacuum and passing of pre-heated hot air removes moisture from the corrugated cardboard during its manufacture and reduces or eliminates a need for an additional drying step.

5. The method of claim 1, wherein the application of vacuum creates a pressure differential from the longitudinal edge of the fluted linerboard sandwiched by the upper and lower sheets of linerboard to another longitudinal edge of the fluted linerboard sandwiched by the upper and lower sheets of linerboard.

6. The method of claim 1, wherein the core of fluted linerboard and upper and lower sheets of linerboard are fed on an assembly line in a direction of travel perpendicular to a longitudinal direction of the flutes.

7. The method of claim 6, wherein the degree of vacuum pressure and hot air pressure are controlled depending upon a flow rate of travel of fluted linerboard and upper and lower sheets of linerboard, a width of the corrugated cardboard being manufactured, and/or a line speed of the assembly line.

8. A method for manufacturing corrugated cardboard, comprising:

providing a core of fluted linerboard with elongate flutes having a series of convex apices;

applying adhesive to the convex apices of the fluted linerboard;

providing upper and lower sheets of linerboard to sandwich the core of fluted linerboard therebetween;

feeding the core of fluted linerboard and upper and lower sheets of linerboard on an assembly line in a direction of travel perpendicular to a longitudinal direction of the flutes; and applying a vacuum along a longitudinal edge of the fluted linerboard sandwiched by the upper and lower sheets of linerboard to reduce the pressure between the upper and lower sheets of linerboard to cause the upper and lower sheets of linerboard to be drawn into bonding contact with the core of fluted linerboard, and wherein as the core of fluted linerboard and upper and lower sheets of linerboard are fed on the assembly line in the direction of travel perpendicular to a longitudinal direction of the flutes, warm or hot air is passed through the fluted linerboard sandwiched by the upper and lower sheets of linerboard in alternating left to right and right to left directions.

* * * * *